US010204605B1

(12) United States Patent
Kwok et al.

(10) Patent No.: US 10,204,605 B1
(45) Date of Patent: Feb. 12, 2019

(54) DETACHABLE WIND GUARD FOR FLUTE EMBOUCHURE HOLE

(71) Applicant: Win-D-Fender, LLC, Bartonville, TX (US)

(72) Inventors: Clem Kwok, Fort Worth, TX (US); Patrick Reeves, Argyle, TX (US); Nathan Mark Dooly, Grapevine, TX (US)

(73) Assignee: Win-D-Fender, LLC, Bartonville, TX (US)

( * ) Notice: Subject to any disclaimer, the term of this patent is extended or adjusted under 35 U.S.C. 154(b) by 0 days.

(21) Appl. No.: 15/822,696

(22) Filed: Nov. 27, 2017

(51) Int. Cl.
*G10D 7/02* (2006.01)
*G10D 9/02* (2006.01)

(52) U.S. Cl.
CPC ..... *G10D 7/02* (2013.01); *G10D 9/02* (2013.01)

(58) Field of Classification Search
None
See application file for complete search history.

(56) References Cited

U.S. PATENT DOCUMENTS 801,086 A * 10/1905 Jenks ..... G10D 7/026 84/380 C
1,704,147 A * 3/1929 Paulson ..... G10D 9/02 84/380 C
3,599,526 A * 8/1971 Sollecito ..... G10D 9/02 84/384
4,233,877 A * 11/1980 Okami ..... G10D 7/02 84/384
8,975,499 B1 * 3/2015 Stoutenborough ..... G10D 9/02 84/465

* cited by examiner

*Primary Examiner* — Robert W Horn
(74) *Attorney, Agent, or Firm* — Yee & Associates, P.C.; Christopher P. O'Hagan

(57) ABSTRACT

The invention provides a detachable wind guard for a flute-type instrument comprising an elongate, arcuate cover configured to wrap over a flute barrel. The cover has a center section with a radius larger than the radius of the flute barrel and includes a tapered, recessed facing edge configured to leave an embouchure hole uncovered when the wind guard is attached to the flute barrel. End sections taper to a radius sized to conform to the flute barrel. An elongate, arcuate holder positioned opposite the cover has a radius sized to conform to the flute barrel. A connector pin passes through knuckles on both the cover and holder to form a hinge that allows the wind guard to open in a clamshell manner. Torsion springs around the connector pin bias the holder in a closed position.

12 Claims, 12 Drawing Sheets

DETACHABLE WIND GUARD FOR FLUTE EMBOUCHURE HOLE

TECHNICAL FIELD

The present invention relates to musical instruments and more specifically to a detachable wind guard for flutes.

BACKGROUND OF THE INVENTION

Unlike woodwind instruments with reeds, flutes are aerophones or reedless wind instrument that produces sound from the flow of air across an opening. Nearly all musical instruments comprise two basic elements: a generator that produces a vibration, and a resonator that amplifies the vibration and modifies it to create the sound of the instrument. The generator on a flute is the mouth hole edge against which the player's breath is directed. The stream of air from the player's lips travels across the embouchure-hole opening and strikes against the sharp further edge of the hole. When the airstream meets the edge it does not divide into two separate airstreams. Instead, a wave-like displacement travels along it and deflects it causing the airstream to rapidly fluctuate between going into the hole and going away from the hole, as shown in FIG. 1. This sets up a rapid vibration at the head of the tube.

The speed of this displacement wave on the air stream is about half the airspeed of the airstream itself (which is typically in the range 20 to 60 meters per second, depending on the air pressure in the player's mouth). If the airstream speed is carefully matched to the frequency of the note being played, then the stream will flow into and out of the embouchure hole at its further edge in just the right phase to reinforce the sound and cause the flute to produce a sustained note.

The Western concert flute is a transverse treble flute that is closed at the top. An embouchure hole is positioned near the top. The hole is covered and surrounded by a lip plate, which is a curved, oval-shaped metal plate with a hole aligned over the embouchure hole. The flute has circular tone holes larger than the finger holes of its baroque predecessors. The size and placement of tone holes, key mechanism, and fingering system used to produce the notes in the flute's range were evolved from 1832 to 1847 by Theobald Boehm.

Precise control of the airstream over the embouchure hole is crucial for producing notes with a flute. Unfortunately, because of the open airstream passing over the embouchure hole the flautist is at the mercy of ambient air currents. In windy conditions, for example in outdoor concerts or marching band shows, control of the airstream is difficult if not impossible, effectively silencing the flute. Even in indoor conditions flute players sometimes encounter trouble playing under or next to fans, HVAC vents, or close to windows or other areas where there are heavy air currents. In the past, flutists have tried to mitigate the problem with makeshift measures such as surrounding themselves with music stands, turning backs to audiences to avoid wind gusts, etc., none of which is optimal.

SUMMARY OF THE INVENTION

The invention provides a detachable wind guard for a flute-type instrument. The wind guard comprises an elongate, arcuate cover configured to wrap over the top a flute barrel. The cover has a center section with a radius larger than the radius of the flute barrel and includes a tapered, recessed facing edge configured to leave an embouchure hole uncovered when the wind guard is attached to the flute barrel, providing space for a musician's lips adjacent the embouchure hole. The cover has end sections that taper to a radius sized to conform to the outer surface of the flute barrel. Vent holes in the cover are positioned approximately perpendicular to the musician's airstream passing over the embouchure hole.

An elongate, arcuate holder is positioned opposite the cover and configured to wrap under the flute barrel and has a radius sized to conform to the outer surface of the flute barrel.

A connector pin passes through knuckles on both the cover and holder to form a hinge that allows the cover and holder to open and close in a clamshell manner. Torsion springs around the connector pin bias the holder in a closed position. A thumb tab extends perpendicularly from the holder to allow one-hand operation of the hinge.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 2:
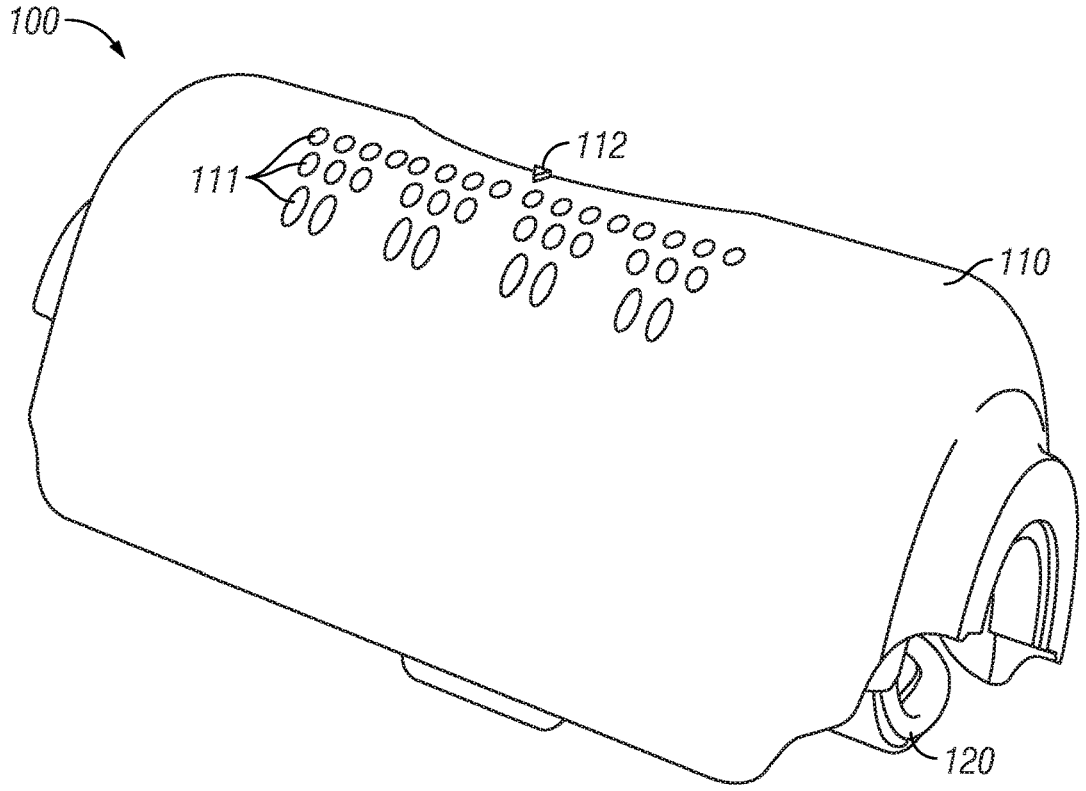
FIG. 2 is a top perspective view of a flute wind guard in accordance with an embodiment of the invention.
Figure 3:
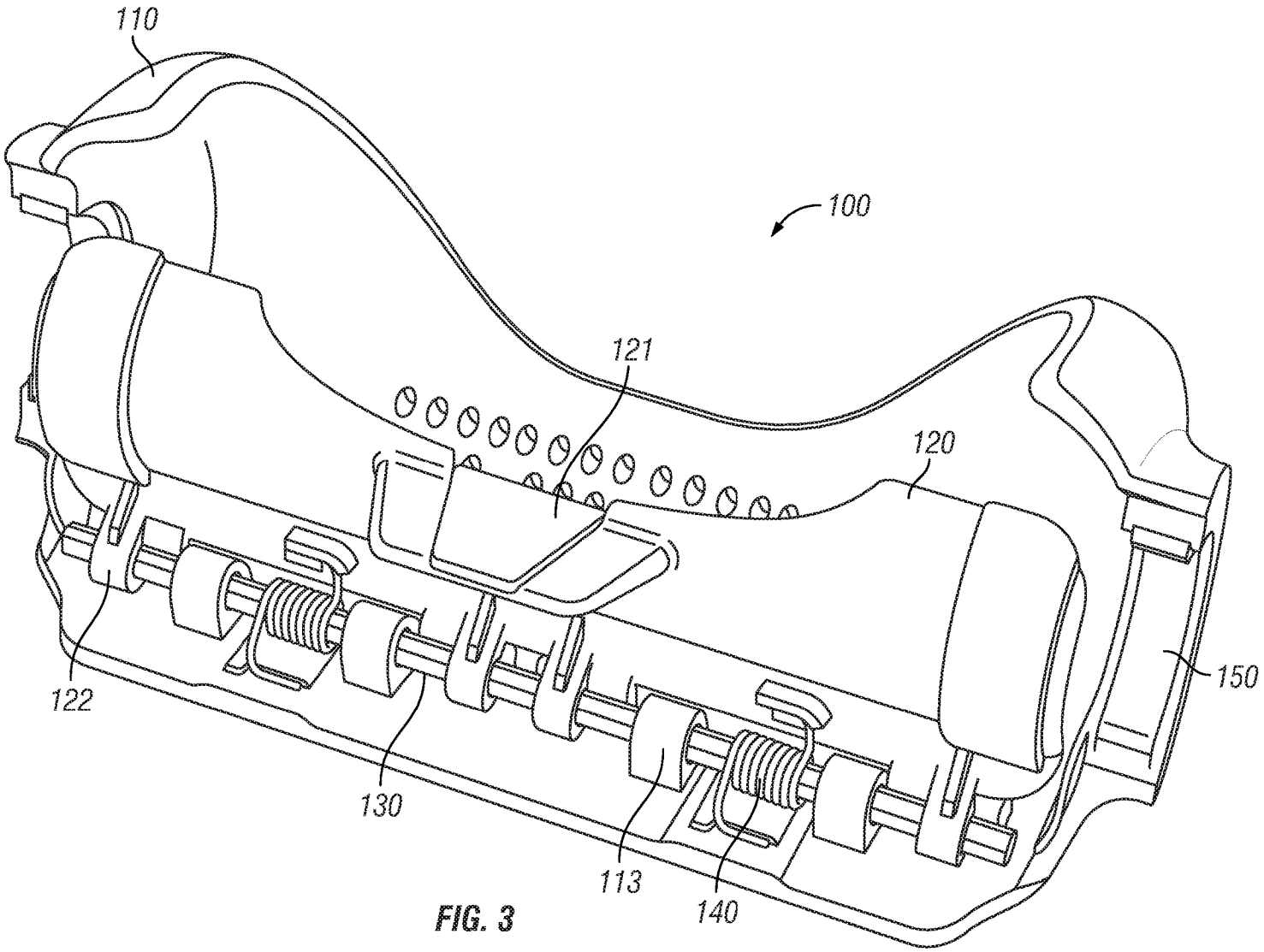
FIG. 3 is a bottom perspective view of a flute wind guard in accordance with an embodiment of the invention.

The present invention shields the embouchure hole of a flute from all directions without interfering with the airstream produced by the player. Referring to FIG. 2, a top perspective view of a flute wind guard 100 is shown in accordance with an embodiment of the invention. FIG. 3 is a bottom perspective view of a flute wind guard in accordance with an embodiment of the invention. The wind guard 100 is a hinged, arcuate, clam shell-type device that is designed to be detachably close around the barrel of a flute. The wind guard 100 comprises an upper cover 110 and a lower holder 120 that hinge around a connecting pin 130 that passes through knuckles 113, 122 in the cover 110 and holder 120, respectively. As shown in FIG. 3, the connector pin 130 also passes through torsion springs 140 that bias the wind guard in the closed position by default.

In an embodiment of the invention the cover 100 and holder 120 are made by injection molding. Examples of suitable materials for manufacture include, without limitation, acrylonitrile butadiene styrene (ABS), polycarbonate/acrylonitrile butadiene styrene (PC-ABS), Food grade ABS, Nylon, polylactic acid (PLA), carbon fiber and other plastic or moldable materials. Other embodiments of the invention may use other materials to make the components, including without limitation, stainless steel, gold, aluminum, and other suitable metals or moldable plastics.

The compact size and lightweight materials make the wind guard 100 portable and well suited for use in a mobile situation such as a marching band. Weight is an important factor, especially in regards to flute, since the distance between the embouchure hole/lip plate and the fulcrum of the musician's closet thumb is a significant lever arm. Adding too much weight to the end of that lever arm will make it difficult for the musician to hold the flute properly and interfere with playing. In preferred embodiments, the wind guard weighs 38 g (1.3 oz) or less, depending on the choice of materials.

Figure 7:
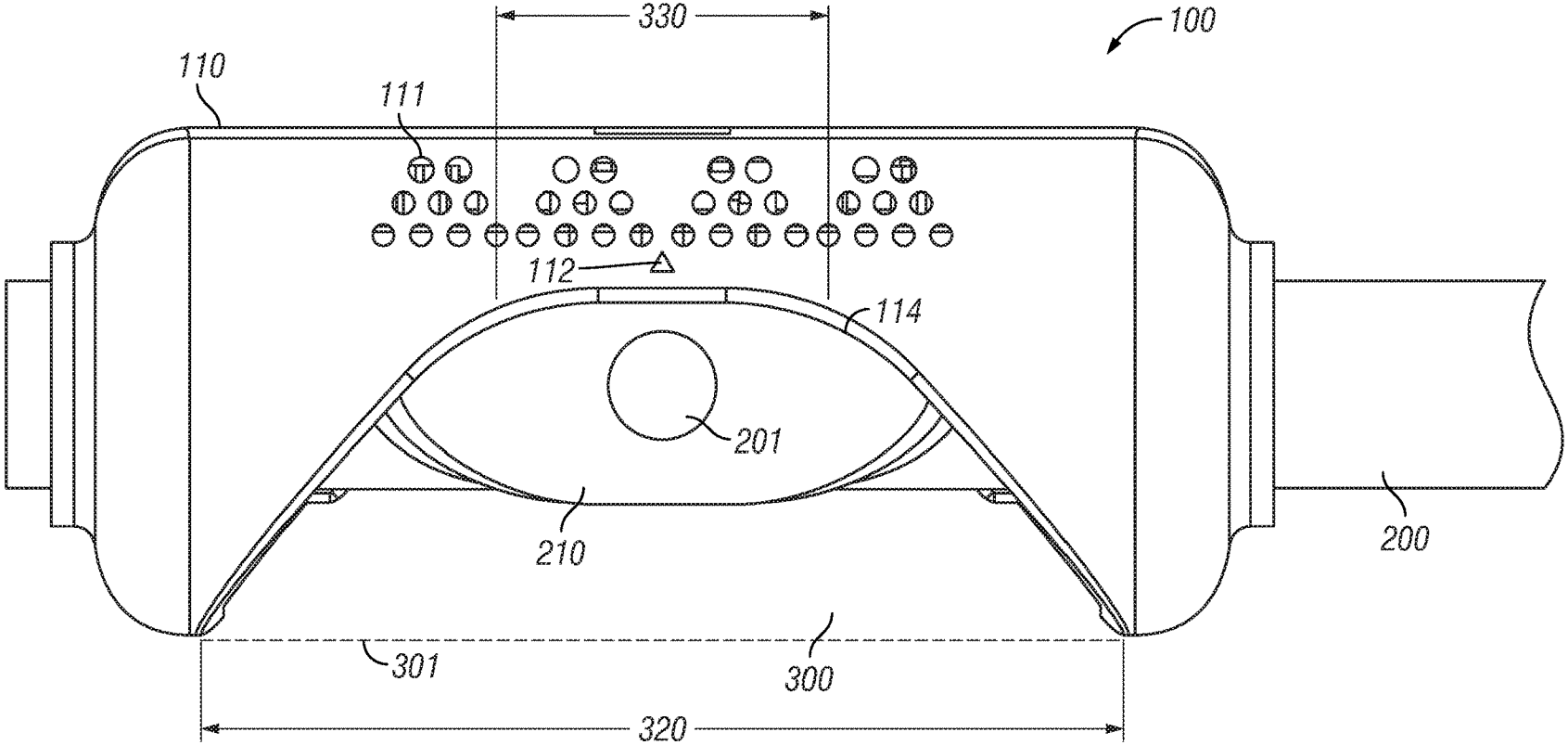
FIG. 7 is a top view of a flute wind guard attached to the head joint of a flute in accordance with an embodiment of the invention.
Figure 8:
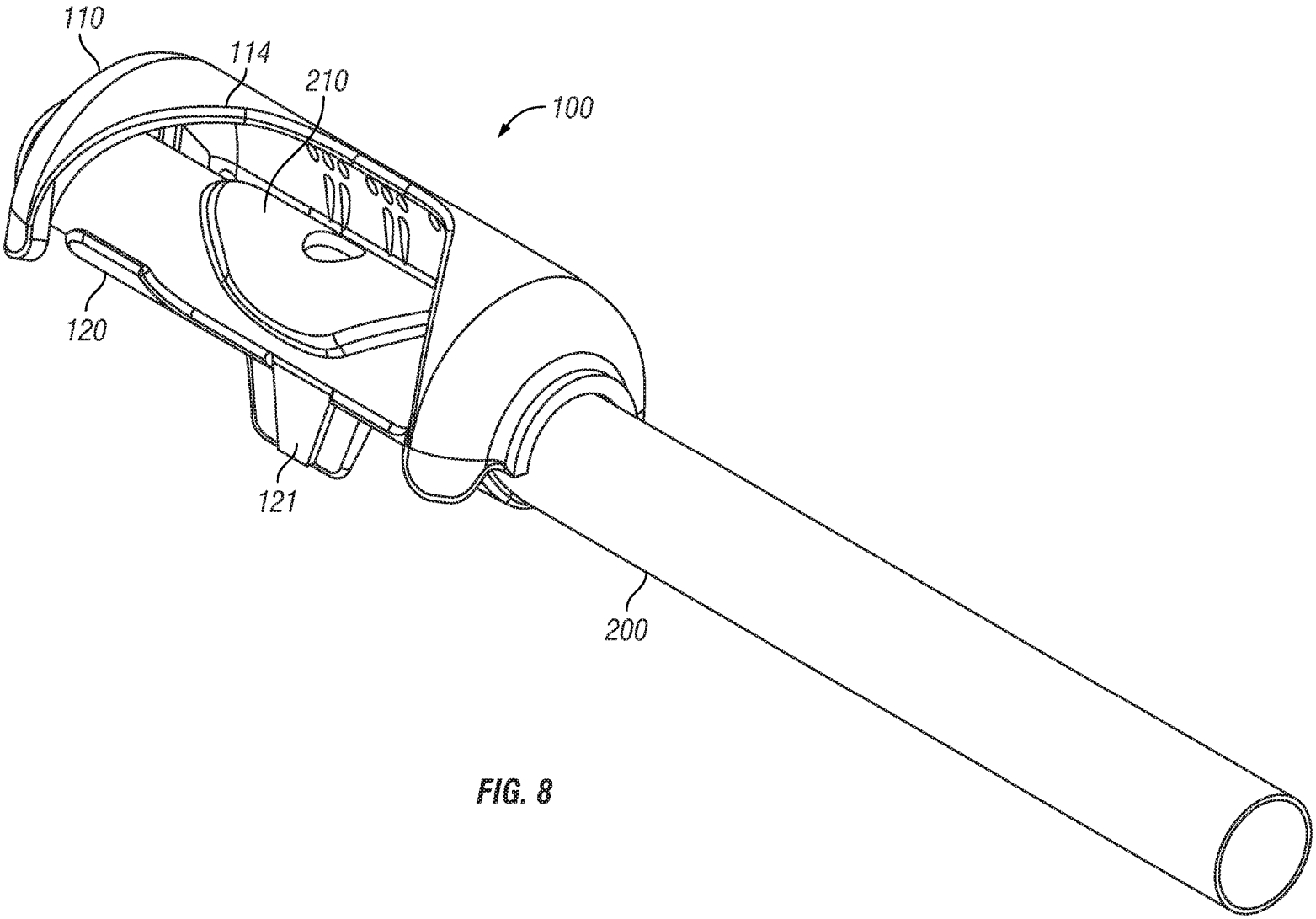
FIG. 8 is a top perspective view of a flute wind guard attached to the head joint of a flute in accordance with an embodiment of the invention.

The cover 110 has an elongated, arcuate shape that wraps over the top of the barrel of a flute. The center section of the cover 110 has a radius sized to provide clearance for airflow over the embouchure hole, as shown in FIGS. 7 and 8. The clearance between the outer surface of the flute barrel and the cover 110 may range from approximately 12 mm to 20 mm.

Figure 6:
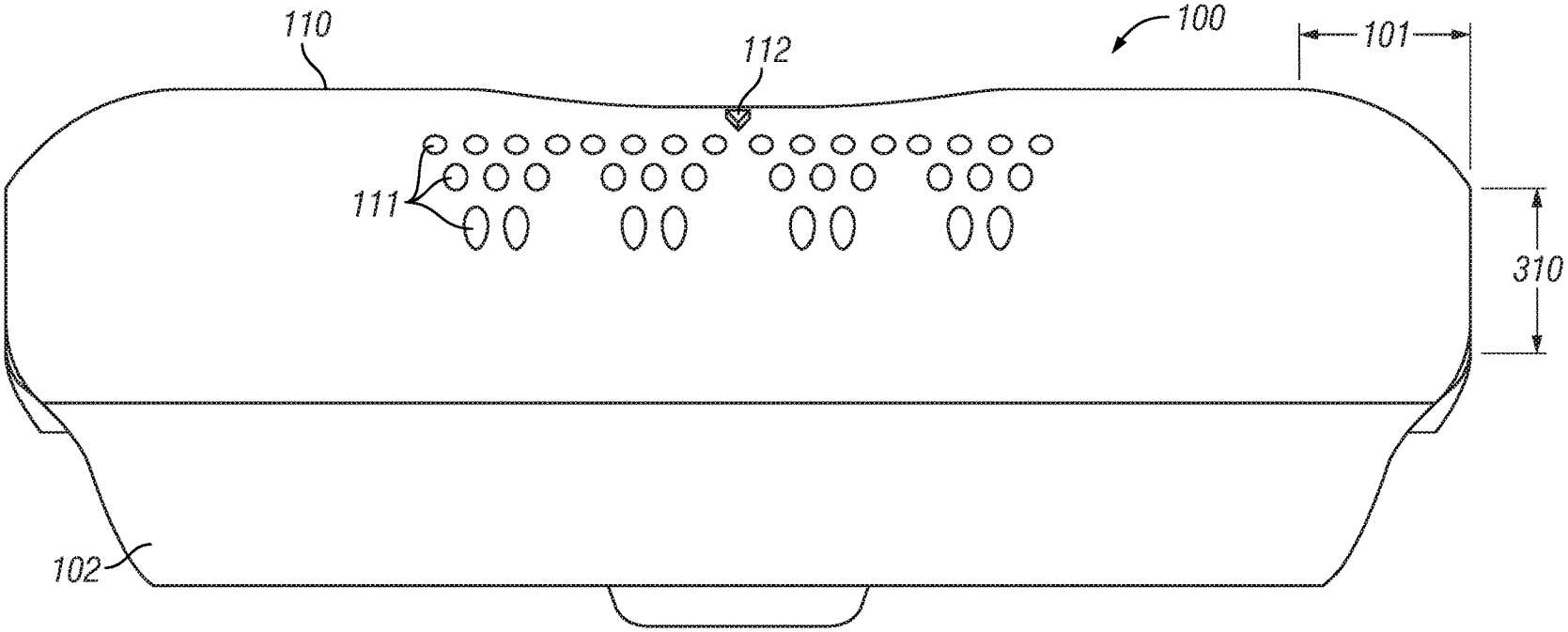
FIG. 6 is a front view of a flute wind guard in accordance with an embodiment of the invention.

As shown in FIG. 6, the end sections 101 of the cover 110 taper to a smaller radius 310 sized to provide conformal contact with the flute when the wind guard 100 is in the closed position. The arcuate shape and tapered ends of the cover 110 have the advantage of blocking air currents from all directions, save the musician's mouth.

The holder 120 also has an arcuate shape. However, unlike the cover 110, the holder 120 has a radius along its entire length that is sized to provide close conformity to the flute barrel with minimal clearance from the surface. Since the holder is positioned opposite the embouchure hole of the flute it does not need to provide clearance for airflow. In addition to blocking wind from the bottom and sides, the holder 120 provides counterforce to keep the wind guard 100 in place.

Figure 4:
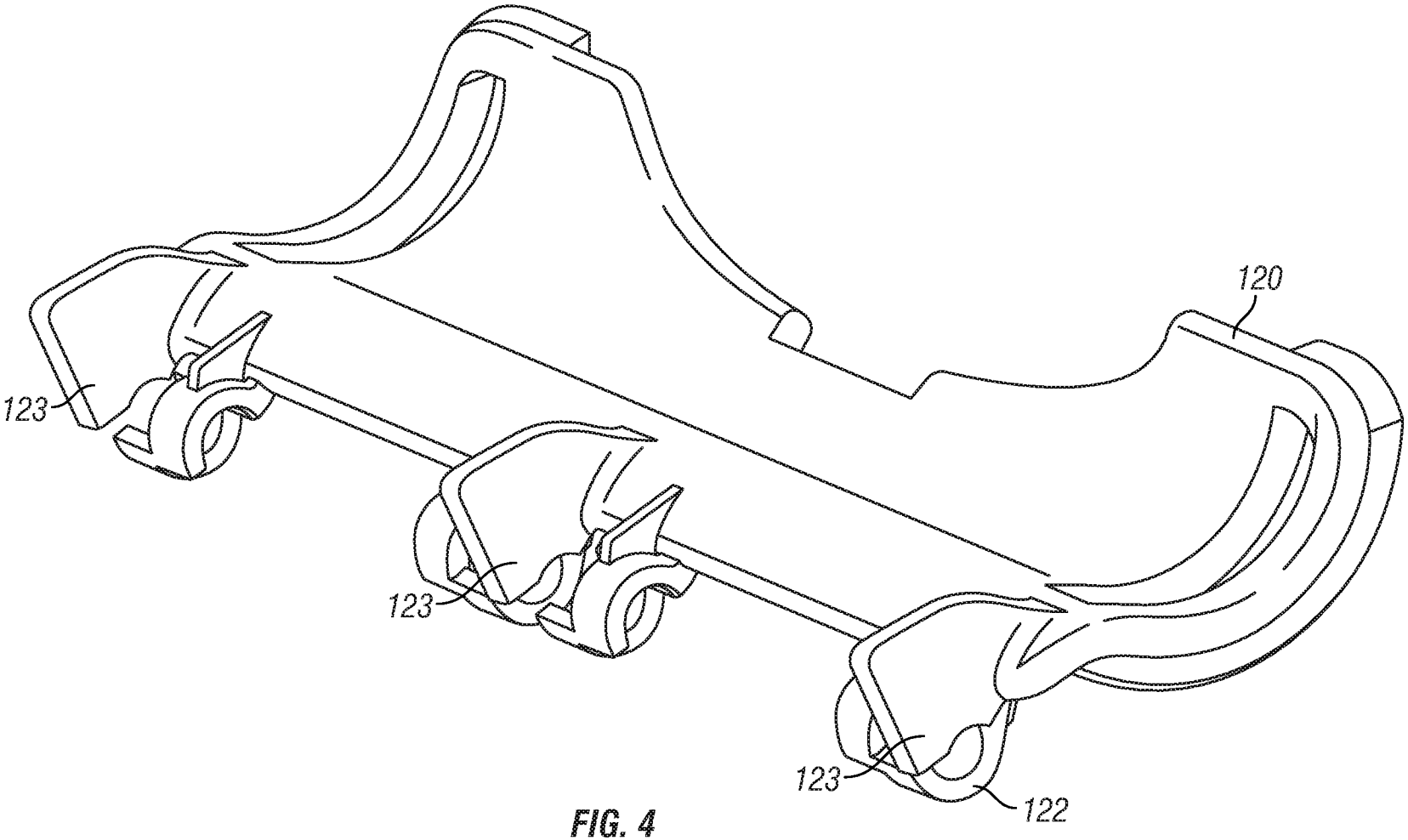
FIG. 4 is a top perspective view of the holder element of the wind guard in accordance with an embodiment of the invention.

FIG. 4 is a top perspective view of the holder element of the wind guard in accordance with an embodiment of the invention. As seen more clearly in this view, the holder 120 also includes a plurality of hinge stops 123 that prevent the holder 120 from being damaged and prevent premature wear.

Figure 5:
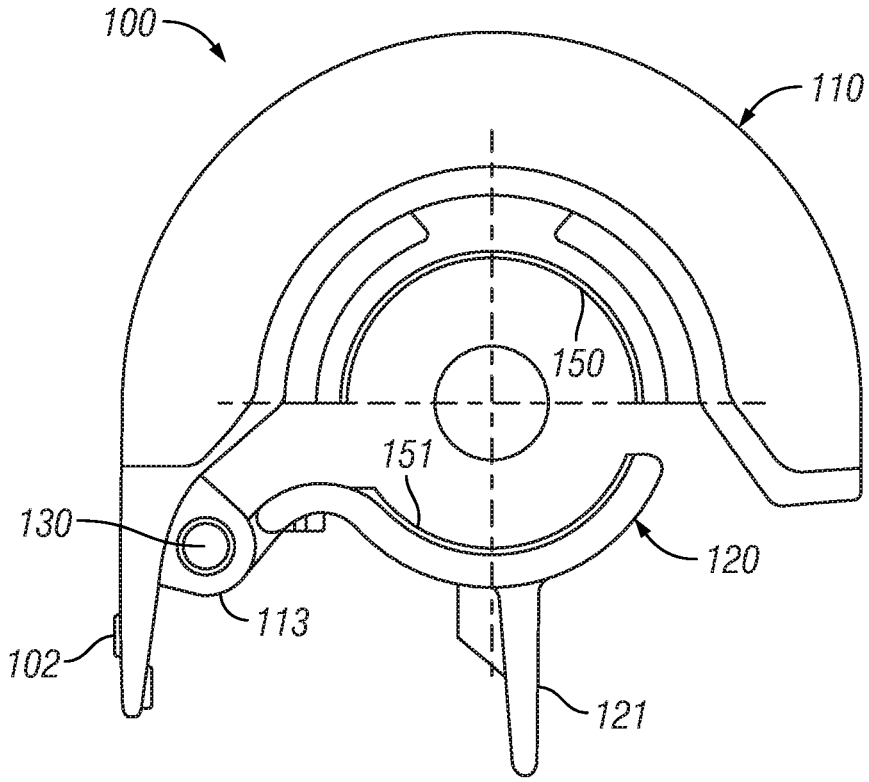
FIG. 5 is a side view of a flute wind guard in accordance with an embodiment of the invention.

FIG. 5 shows a side view of the wind guard 100 in the closed position. As can be seen in this view, the arcuate shapes of the upper cover 110 and lower holder 120 form upper and lower portions of the circumference of a circle. The diameter of this circumference is sized to tightly fit around the barrel of a flute. It will be understood by those skilled in the art that embodiments of the invention may be sized differently to fit different members of the flute family, e.g., concert flute in C, alto flute, bass flute, piccolo, fife, etc., while staying within the scope of the invention.

Figure 10:
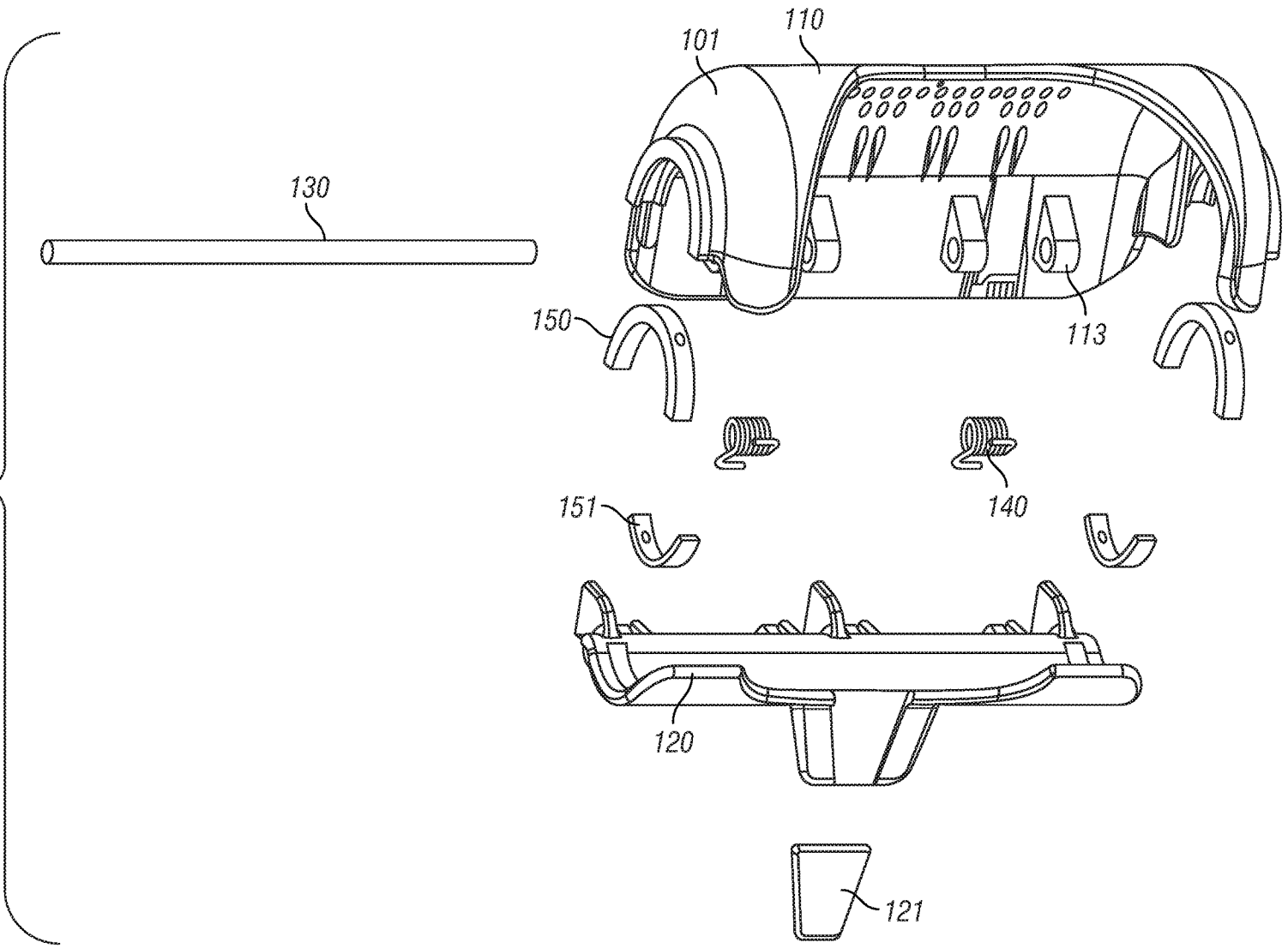
FIG. 10 is an exploded perspective view of a flute wind guard in accordance with an embodiment of the invention.

In one embodiment rubber grips 150, 151 line the inner surfaces of the contact points located at the ends of the cover 110 and holder 120. These rubber grips 150, 151 provide contact friction with the flute to hold the wind guard in place as well as protect the surface of the flute from scratching. The rubber grips 150, 151 are shown more clearly in the exploded view in FIG. 10.

Also shown in FIGS. 5 and 6, a fingerplate 102 extends from the bottom of the front longitudinal edge of the cover 110. This fingerplate 102 is configured to be used as a moment arm to allow actuation of the spring loaded thumb tab 121 on the holder 120 to permit single-handed opening of the wind guard.

In addition to blocking unwanted air currents, the shape of the wind guard 100 is designed to enhance and project the sound of the flute. The wind guard 100 improves sounds quality and projects sound further, similar to cupping a hand over a cell phone speaker. It also acts as a sound mirror to reflect sound back to the flute player, providing immediate feedback to help the musician better hear his own playing and adjust, thereby improving performance. In this regard, the wind guard 100 has benefits aside from simply blocking wind and can be used under normal playing conditions, indoors, with no wind, to aid in tone development for flutists, or to allow flutists to hear themselves more clearly while playing with a group for tuning, etc.

FIG. 6 is a front view of a flute wind guard in accordance with an embodiment of the invention. As shown in FIGS. 2 and 6, the cover 110 of the wind guard 100 also includes a plurality of vent holes 111 arranged in several tiers. Also shown in the figures is an alignment mark 112 that is used to help align the wind guard 100 with the embouchure hole 201 and lip plate 210 of the flute, as shown in FIG. 7. When the wind guard 100 is properly aligned and positioned on the flute the vent holes 111 are on the opposite side of the flute from musician's mouth, approximately perpendicular to the flutist's airstream across the embouchure hole.

The position of the wind guard 100 is rotationally adjustable around the flute barrel and can be realigned based on wind conditions. In more windy conditions, the wind guard 100 would be rotated closer towards the nose of the musician, effectively offering more cover of the embouchure hole 201. During less windy conditions, the wind guard 100 is rotated away from the musician's nose to allow more movement of the face and lips to blow into the embouchure hole.

The vent holes 111 serve several functions, one of which is to enhance sound projection similar to vents on a speaker, since most of a flute's sound projects at or near the lip plate. The vent holes 111 also prevent the buildup of condensation from the musician's breath.

Figure 1:
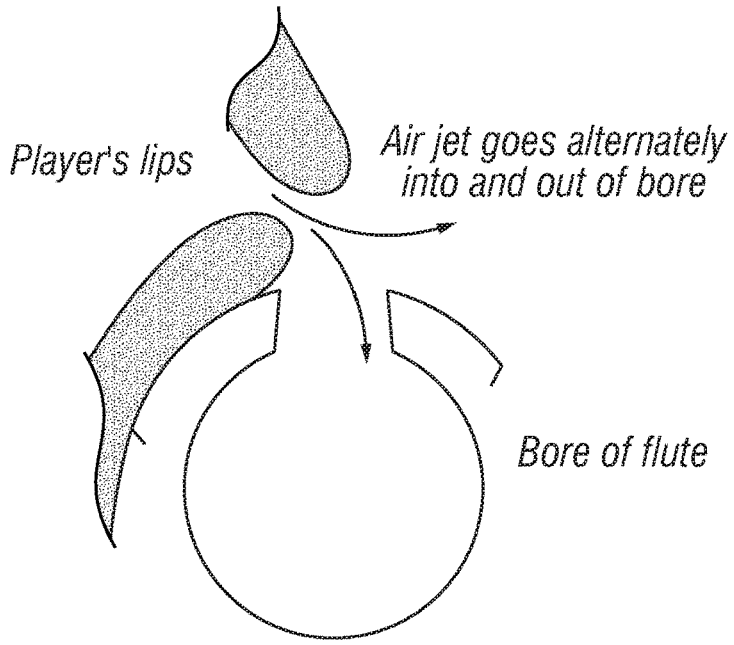
FIG. 1 is a cross section view illustrating airflow over the embouchure hole of a flute.

The vent holes 111 also limit blow back as the player's airstream travels across the embouchure hole and contacts the inside of the cover 110. Without the vents 111, the airstream would tend to reflect back into the player's face. Not only would this be uncomfortable for the player, but it would also create turbulence inside the cover that is disruptive to sound production, making the wind guard self-defeating. Since the air traveling across the lip plate travels away from the flute in an upward direction (as shown in FIG. 1), the vent holes near the top of the cover allow a more direct escape route for the air. In one embodiment of the invention, the vent holes have a diameter of approximately 2-3 mm.

FIG. 7 is a top view of a flute wind guard 100 attached to the head joint 200 of a flute. The wind guard 100 is positioned over the lip plate 210 and embouchure hole 201. As illustrated clearly in this view, the top cover portion 110 has a tapered, recessed facing edge 114 defining a cutout area 300 that recedes from the leading edge of the cover defined by dashed line 301. The tapered cutout area 300 is approximately trapezoidal in shape, defined by the leading edge 301 and a radiused (rounded) facing edge 114.

Figure 11:
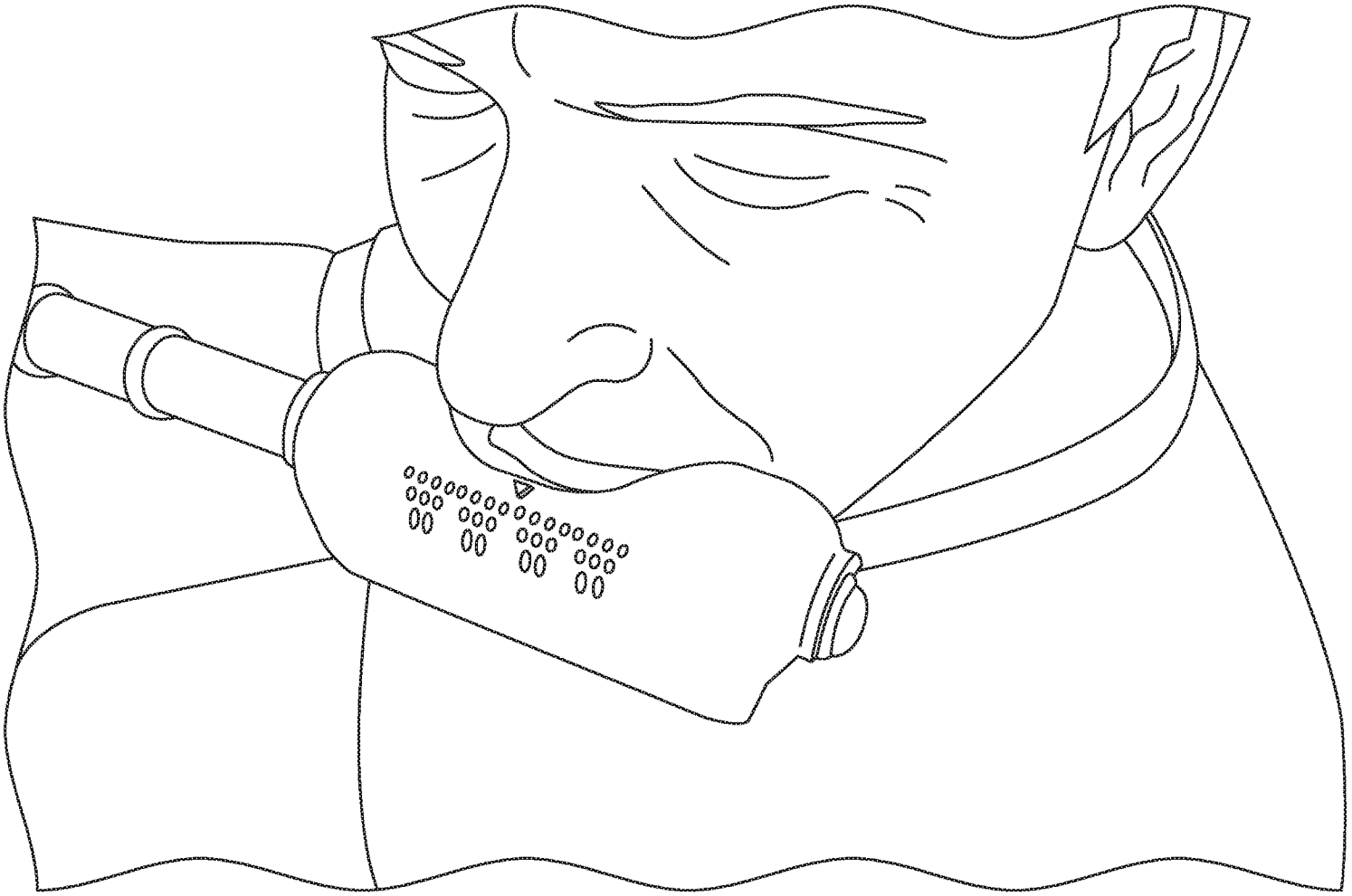
FIG. 11 illustrates the wind guard in use with a flute.

The cutout area 300 provides space for the flute player to place his mouth against the lip plate 210 without obstruction, as shown in FIG. 11. The top and bottom edges are also rolled to improve comfort and prevent scratches and chafing of the musician's face. The cutout area 300 is sized to prevent the cover 110 from interfering with the musician's lips, nose and cheeks. In one embodiment of the invention the opening of the cutout area 300 has a width of approximately 84 mm, shown by arrow 320. The cutout area 300 tapers to a width of approximately 35 mm at its narrowest, defined by arrow 330.

Figure 9:
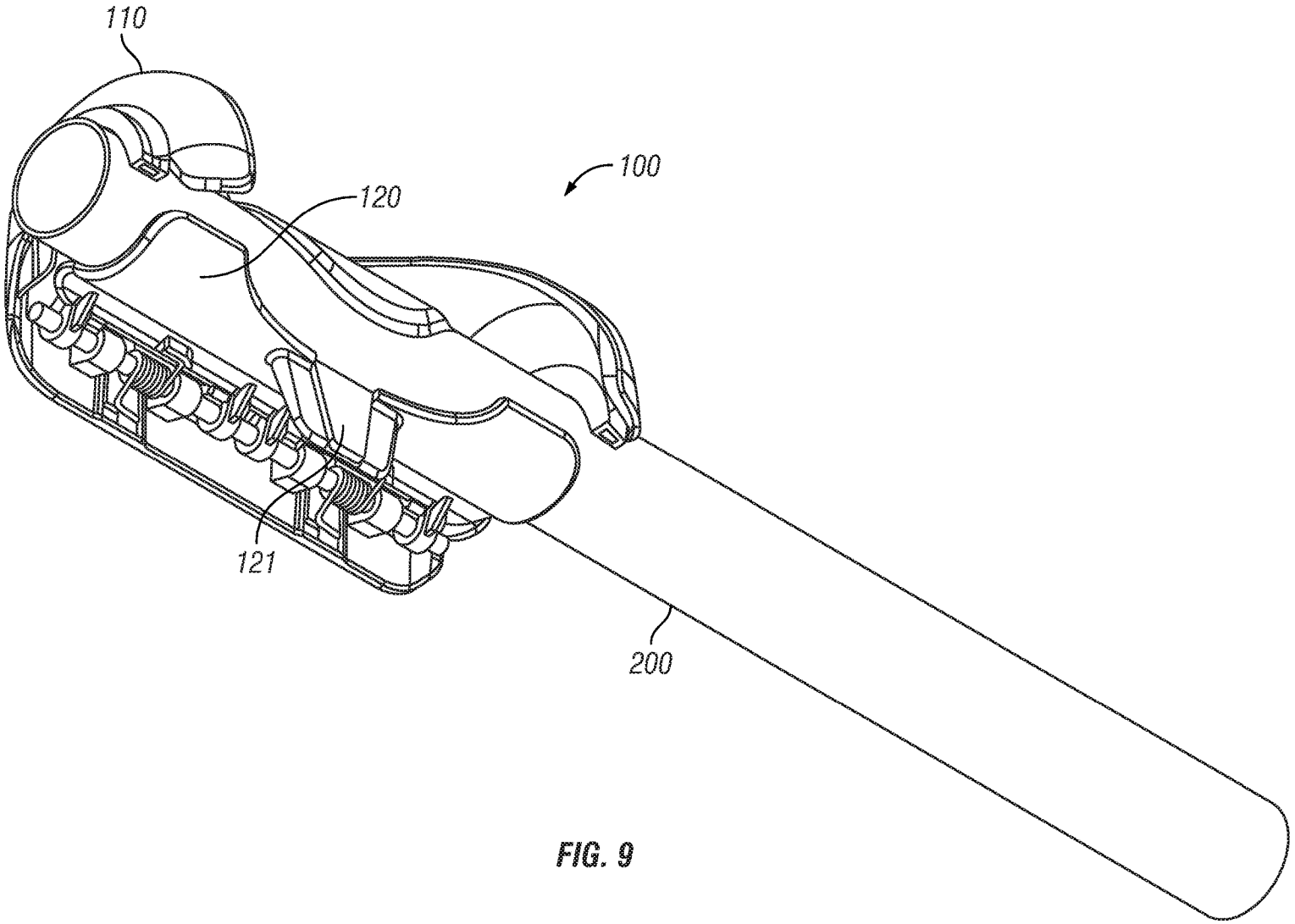
FIG. 9 is a bottom perspective view of a flute wind guard attached to the head joint of a flute in accordance with an embodiment of the invention.

FIG. 8 and FIG. 9 are a top and bottom perspective views of the wind guard attached to the head joint of a flute. These views better illustrate how the clamshell design of the wind guard 100 allow it to wrap around and clamp onto the flute barrel. FIG. 8 depicts how the cutout area in the cover 110 allows unobstructed access to the lip plate 210.

The thumb tab 121 allows one-handed installation and removal of the wind guard 100. To prevent interference with the musician's chin, the thumb tab 121 is located on the bottom holder 120 so as to be positioned approximately below the embouchure hole when the wind guard 100 is positioned properly with the embouchure hole unobstructed, as shown most clearly in FIGS. 5 and 8.

Figure 12:
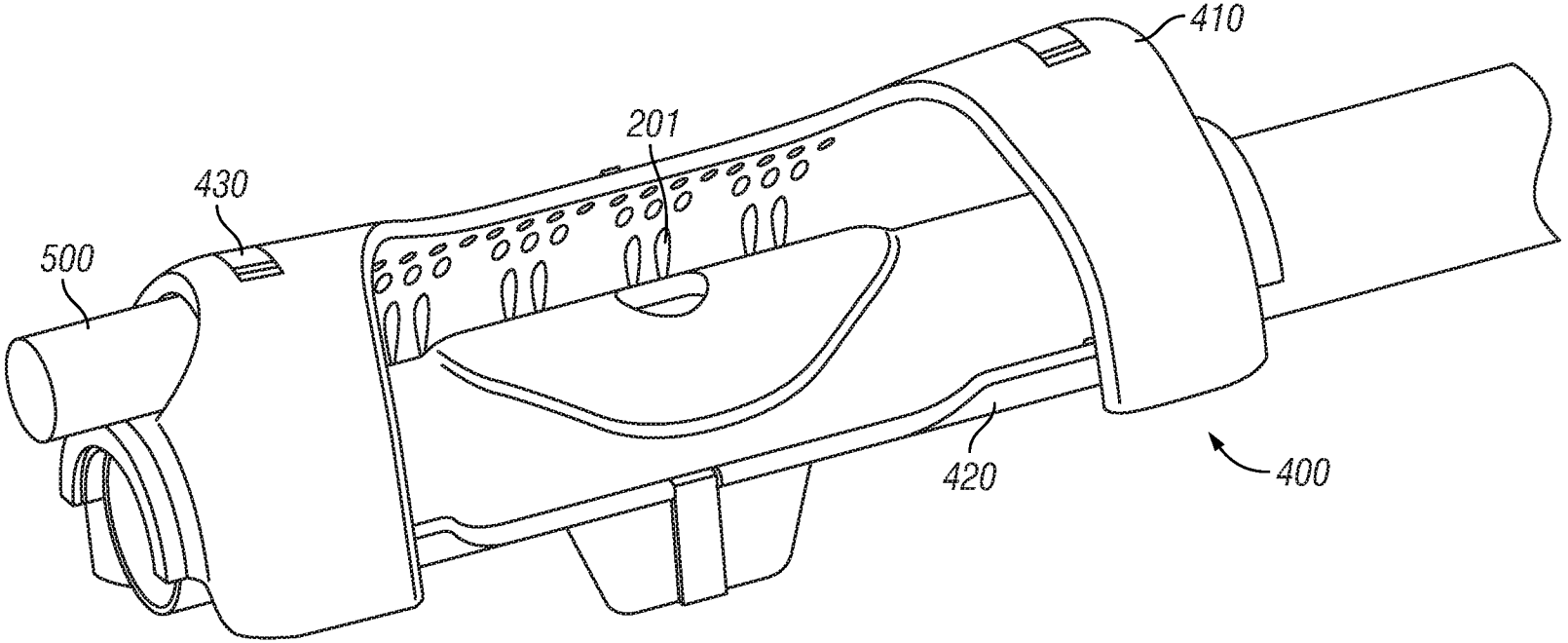
FIG. 12 is a perspective view of an alternate embodiment of the invention that incorporates a microphone holder.
Figure 13:
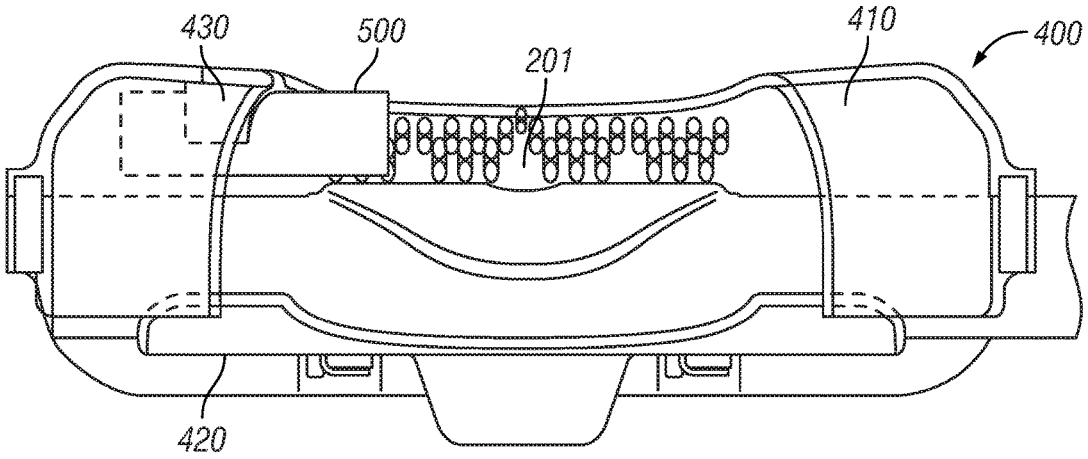
FIG. 13 is a back, cross-section view of the alternate embodiment of the invention.
Figure 14:
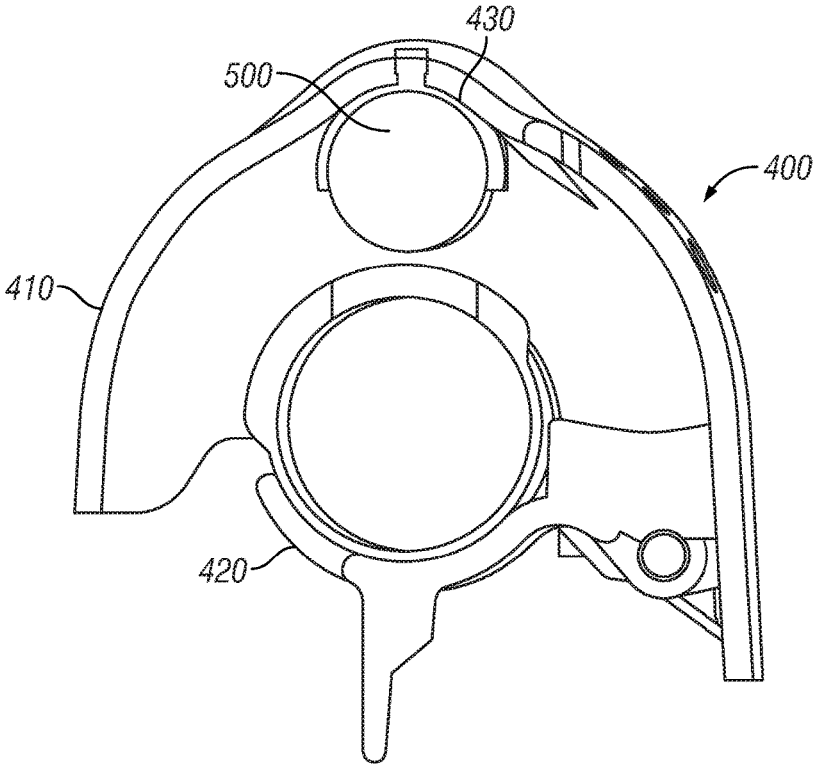
FIG. 14 is a side, cross-section view of the alternate embodiment of the invention.

FIGS. 12-14 show an alternate embodiment of the wind guard 400 that is designed to hold a microphone. FIG. 12 is a perspective view of the alternate embodiment showing a microphone 500 extending through an opening in the top cover 410 of the wind guard 400. The microphone 500 is held in place by a microphone clip 430 that is coupled to the roof of the cover 410.

FIG. 13 is a back, cross-section view of the wind guard 400 that more clearly illustrates the microphone clip 430 holding the microphone 500 in close proximity to the embouchure hole 201 of the flute. FIG. 14 is a side, cross-section view of the wind guard that also illustrates the microphone 500 held in place by the clip 430. Also shown more clearly in FIG. 14, the cover 410 in this embodiment has a slightly domed roof to accommodate the added diameter of the microphone. It will be understood by those skilled in the art that the size of the cover 410 and clip 430 may vary to accommodate different sized microphones.

The alternate embodiment of the wind guard shown in FIGS. 12-14 improves the quality of audio recording with the microphone. In addition to shielding the microphone from wind noise, the wind guard 400 also allows the microphone 500 to take advantage of the sound mirror effect and improved acoustics described above.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

We claim:

1. A detachable wind guard for a flute-type instrument, the wind guard comprising:

an elongate, arcuate cover configured to wrap over a flute barrel, wherein the cover includes:

a center section with a radius larger than the radius of the flute barrel, wherein the center section has a facing edge that recedes in a tapered manner to define a cutout area in the arcuate cover; and end sections at opposite longitudinal ends of the cover that taper to a radius sized to conform to the outer surface of the flute barrel;

an elongate, arcuate holder positioned opposite the cover and configured to wrap under the flute barrel, wherein the holder has a radius along its length sized to conform to the outer surface of the flute barrel;

a connector pin passing through a first plurality of knuckles on the cover and a second plurality of knuckles on the holder to form a hinge, wherein the hinge is configured to allow the cover and holder to open and close in a clamshell manner; and at least one torsion spring around the connector pin, wherein the torsion spring is configured to bias the holder in a closed position.

2. The wind guard according to claim 1, wherein the cover further comprises a plurality of vent holes.

3. The wind guard according to claim 2, wherein the vent holes are located on a side of the cover opposite the recessed edge.

4. The wind guard according to claim 2, wherein the vent holes have a diameter of 2-3 mm.

5. The wind guard according to claim 1, wherein the center section of the cover has a radius that provides a clearance of 12 mm-20 mm between the outer surface of the flute barrel and the cover.

6. The wind guard according to claim 1, wherein the holder further comprises a lever extending perpendicularly from the holder.

7. The wind guard according to claim 1, wherein the cover further comprises an alignment mark positioned adjacent the center of the tapered, recessed facing edge.

8. The wind guard according to claim 1, further comprising:

a first plurality of rubber contact pads on an inner surface of the cover; and a second plurality of rubber contact pads on an inner surface of the holder.

9. The wind guard according to claim 1, wherein the wind guard weighs 38 g or less.

10. A method for shielding an embouchure hole of a flute-type instrument from ambient air currents, the method comprising:

coupling a wind guard to flute barrel, wherein the flute guard further comprises:

an elongate, arcuate cover configured to wrap over a flute barrel, wherein the cover includes:

a center section with a radius larger than the radius of the flute barrel, wherein the center section has a facing edge that recedes in a tapered manner to define a cutout area in the arcuate cover; and end sections at opposite longitudinal ends of the cover that taper to a radius sized to conform to the outer surface of the flute barrel;

an elongate, arcuate holder positioned opposite the cover and configured to wrap under the flute barrel, wherein the holder has a radius along its length sized to conform to the outer surface of the flute barrel;

a connector pin passing through a first plurality of knuckles on the cover and a second plurality of knuckles on the holder to form a hinge, wherein the hinge is configured to allow the cover and holder to open and close in a clamshell manner; and at least one torsion spring around the connector pin, wherein the torsion spring is configured to bias the holder in a closed position;

aligning the wind guard with an embouchure hole in the flute barrel; and placing one's lips adjacent the embouchure hole, wherein the lips fit within the cutout area of the arcuate cover defined by the receding facing edge.

11. The method according to claim 10, further comprising aligning the wind guard with the embouchure hole using an alignment mark positioned adjacent the center of the tapered, recessed facing edge.

12. The method according to claim 10, further comprising rotationally adjusting the wind guard around the flute barrel under different ambient conditions, wherein the wind guard is realigned to cover more of the embouchure hole as ambient air currents increase.

* * * * *